US007740459B2

(12) United States Patent
Fuertsch et al.

(10) Patent No.: US 7,740,459 B2
(45) Date of Patent: Jun. 22, 2010

(54) MICROPUMP HAVING A PUMP DIAPHRAGM AND A POLYSILICON LAYER

(75) Inventors: Matthias Fuertsch, Gomaringen (DE); Hubert Benzel, Pliezhausen (DE); Stefan Finkbeiner, Gomaringen (DE); Stefan Pinter, Reutlingen (DE); Frank Fischer, Gomaringen (DE); Heiko Stahl, Reutlingen (DE); Tjalf Pirk, Berlin (DE)

(73) Assignee: Robert Bosch GmbH, Stuttgart (DE)

( * ) Notice: Subject to any disclaimer, the term of this patent is extended or adjusted under 35 U.S.C. 154(b) by 899 days.

(21) Appl. No.: 10/564,370

(22) PCT Filed: Jul. 7, 2004

(86) PCT No.: PCT/DE2004/001447

§ 371 (c)(1),
(2), (4) Date: Jan. 11, 2006

(87) PCT Pub. No.: WO2005/015021

PCT Pub. Date: Feb. 17, 2005

(65) Prior Publication Data

US 2006/0186085 A1 Aug. 24, 2006

(30) Foreign Application Priority Data

Jul. 28, 2003 (DE) ..... 103 34 240

(51) Int. Cl.
*F04B 17/03* (2006.01)

(52) U.S. Cl. ..... 417/413.3

(58) Field of Classification Search ..... 417/413.2, 417/413.3

See application file for complete search history.

(56) References Cited

U.S. PATENT DOCUMENTS

| | | | | |
|---|---|---|---|---|
| 5,096,388 | A | 3/1992 | Weinberg | |
| 5,216,273 | A | 6/1993 | Doering et al. | |
| 6,390,791 | B1 | 5/2002 | Maillefer et al. | |
| 2002/0121529 | A1 * | 9/2002 | Hoummady | 222/113 |

FOREIGN PATENT DOCUMENTS

| | | |
|---|---|---|
| DE | 195 11 198 | 10/1996 |
| EP | 1 226 945 | 7/2002 |
| WO | WO 01/90577 | * 11/2001 |

* cited by examiner

*Primary Examiner*—Charles G Freay
(74) *Attorney, Agent, or Firm*—Kenyon & Kenyon LLP

(57) ABSTRACT

A method for producing a micromechanical component, preferably for fluidic applications having cavities. The component is constructed from two functional layers, the two functional layers being patterned differently using micromechanical methods. A first etch stop layer having a first pattern is applied to a base plate. A first functional layer is applied to the first etch stop layer and to the first contact surfaces of the base plate. A second etch stop layer, having a second pattern, is applied to first functional layer. A second functional layer is applied to the second etch stop layer and to the second contact surfaces of the first functional layer. An etching mask is applied to the second functional layer. The second and the first functional layer are patterned as sacrificial layers by the use of the first and the second etch stop layer by etching methods and/or by using the first and the second etch stop layer. By supplementing patterning of the base plate, additional movable fluidic elements may be implemented, using the method. The method is preferably used for producing a micropump having an epitactic polysilicon layer as the pump diaphragm.

3 Claims, 5 Drawing Sheets

MICROPUMP HAVING A PUMP DIAPHRAGM AND A POLYSILICON LAYER

FIELD OF THE INVENTION

The present invention relates to a method for producing a micromechanical component, preferably for fluidic applications, and a micropump having a pump chamber.

BACKGROUND INFORMATION

Micropumps are used for various technical fields, particularly in the medical field, in order to convey small quantities of fluids in a precise manner. Micromechanical manufacturing methods are used for producing micropumps, silicon being used, for example, which may be simply and precisely patterned using appropriate depositing and etching methods.

This type of micropump is described in U.S. Pat. No. 6,390,791, which is produced on an SOI wafer. This micropump is made up of a triple stack having two glass wafers and an SOI wafer located in between. In order to produce a pump diaphragm, a monocrystalline silicon layer of the SOI wafer is used, for the production, for example, a dry etching method (DRIE) being used for patterning the silicon layer, and a sacrificial oxide etching method being used for exposing the patterns. The disadvantages of this method include that, in the high-rate etching method, the etching depth is established by the etching time, and is therefore not precisely controllable. If one does not keep precisely to the etching time, the result is a thickness variation of the functional layer of which the pump diaphragm is formed. This leads to different pump characteristics of the micropump. In addition, in the conventional method, it is disadvantageous that sacrificial oxide etching steps are required which have the effect of a nonreproducible undercut etching depth, since there is no lateral etch stop.

SUMMARY

It is an object of the present invention to make available a simple and flexible method for producing a component preferably for fluidic applications, and a simple and cost-effective micropump that is to be produced using this method.

One advantage of the method according to the present invention is that, by the use of two functional layers and by the use of two etch stop layers, which may also be used as sacrificial layers, there is a high flexibility in the production of differently patterned functional layers.

The second functional layer is preferably ablated down to the second etch stop layer, corresponding to an etching mask, and subsequently the first functional layer is ablated down to the first etch stop layer, corresponding to the pattern of the second etch stop layer, which is used as the second etching mask. This makes possible a simple and precise patterning of the first and the second functional layer.

In another preferred specific embodiment, the base plate is patterned beginning from the underside to the first etch stop layer, and the first etch stop layer is removed as sacrificial layer in an etching procedure in predetermined regions, the predetermined regions extending between the first functional layer and the base plate. In this way it is possible to expose the first functional layer beginning from the underside.

In one preferred specific embodiment, a lateral etching of the first etch stop layer is limited by the first functional layer, which is applied directly to the base plate, bordering on the fixed regions of the first etch stop layer. This precisely establishes the regions that are created by etching away the first etch stop layer used as a sacrificial layer.

In a further preferred specific embodiment, the first etch stop layer is etched away as a sacrificial layer in established regions via openings in the first functional layer. In this way, too, it is possible to expose the underside of the first functional layer.

In a further preferred specific embodiment, the first etch stop layer is etched away via openings in the base plate before the patterning of the first functional layer. Subsequently, the first functional layer is patterned from the upper side, i.e., from the side of the second etch stop layer. In certain application fields, this procedure may have advantages over the methods described above.

In order to close the patterned regions, preferably a cover plate is applied to the upper side or a bottom plate is applied to the base plate, using an anodic bonding method, and is tightly connected to the component all the way around. In order that movable parts of the second functional layer or movable parts of the base plate are not bonded in response to the bonding method, anti-bonding layers are applied to the upper side of the moving parts of the second functional layer, to the underside of the movable parts of the base plate or to the corresponding regions of the cover plate or the floor plate.

In one other preferred specific embodiment, a sequence of coatings made of a first lower silicon oxide layer, a middle polysilicon layer and an upper second silicon oxide layer is used as the first etch stop layer. The use of this sequence of layers offers the advantage that, after the opening of the enveloping silicon oxide layer at one location, it makes possible a rapid etching of large areas of the polysilicon layer, for instance, using xenon difluoride or chlorine trifluoride, especially in comparison to gas phase hydrogen fluoride etching methods. Consequently, the process duration for etching the first etch stop layer is clearly reduced.

Using the method described, one is able to produce, for example, components for fluidic applications, preferably a micropump.

One example micropump according to an example embodiment of the present invention has the advantage that the pump diaphragm is formed of a polysilicon layer. This enables a simple and precise patterning of the pump diaphragm.

The polysilicon layer is preferably developed in different thicknesses in various areas, depending on the function of the polysilicon layer in the respective area. This establishes the mechanical stability of the polysilicon layer according to the desired method of functioning.

By using the polysilicon layer, etch stop layers may be applied on the polysilicon layer during the production of the pump diaphragm, which may be used almost independently of the etching time for the production of a precise thickness of the polysilicon layer.

In one preferred specific embodiment, the polysilicon layer is also used to form the closing element of the intake valve. For the formation of the closing element of the intake valve, it is also advantageous if one is able to set the thickness of the polysilicon layer in a precise manner. With the aid of the thickness of the polysilicon layer, the spring constant, and thus the closing and opening time of the intake valve is varied, within which the intake valve is closed or opened during the compression procedure. A short closing and opening time lead to a great efficiency of the micropump. In addition, by a sufficient thickness it is ensured that the intake valve is securely closed and is robustly resistant to damage.

In still another preferred specific embodiment, the closing element of the outlet valve is also represented by the polysilicon layer. For the desired functioning of the outlet valve, the closing member of the outlet valve, too, has to be produced by a polysilicon layer having a specified thickness.

In yet another preferred specific embodiment, the polysilicon layer, in predefined areas, especially in areas of the intake valve, of the outlet valve and/or of the pump chamber, has a lesser thickness than in other areas. Thereby, corresponding to the various tasks of the polysilicon layer, a different flexibility of the polysilicon layer is set in various areas. Consequently, an optimized polysilicon layer is made available.

Because of the method according to one example embodiment of the present invention, it is possible to produce polysilicon layers as functional layers for a micropump having specified thicknesses. For this, in each case one etch stop layer is used that is applied under the polysilicon layer. A second etch stop layer and a second polysilicon layer are applied onto the first polysilicon layer.

In a further preferred method, the first etch stop layer is removed before the application of the first functional layer in the area of the intake valve, the outlet valve and in the area of the pump chamber. Thereby the geometry of the polysilicon layer is set in a specified manner. Consequently, for example, a purposeful and reproducible setting of the spring constant of the polysilicon layer is made possible in the areas of the intake valve, the outlet valve and in the area of the pump chamber.

BRIEF DESCRIPTION OF THE DRAWINGS

The present invention is explained below in greater detail with reference to the figures.

DETAILED DESCRIPTION OF EXAMPLE EMBODIMENTS

Figure 1:
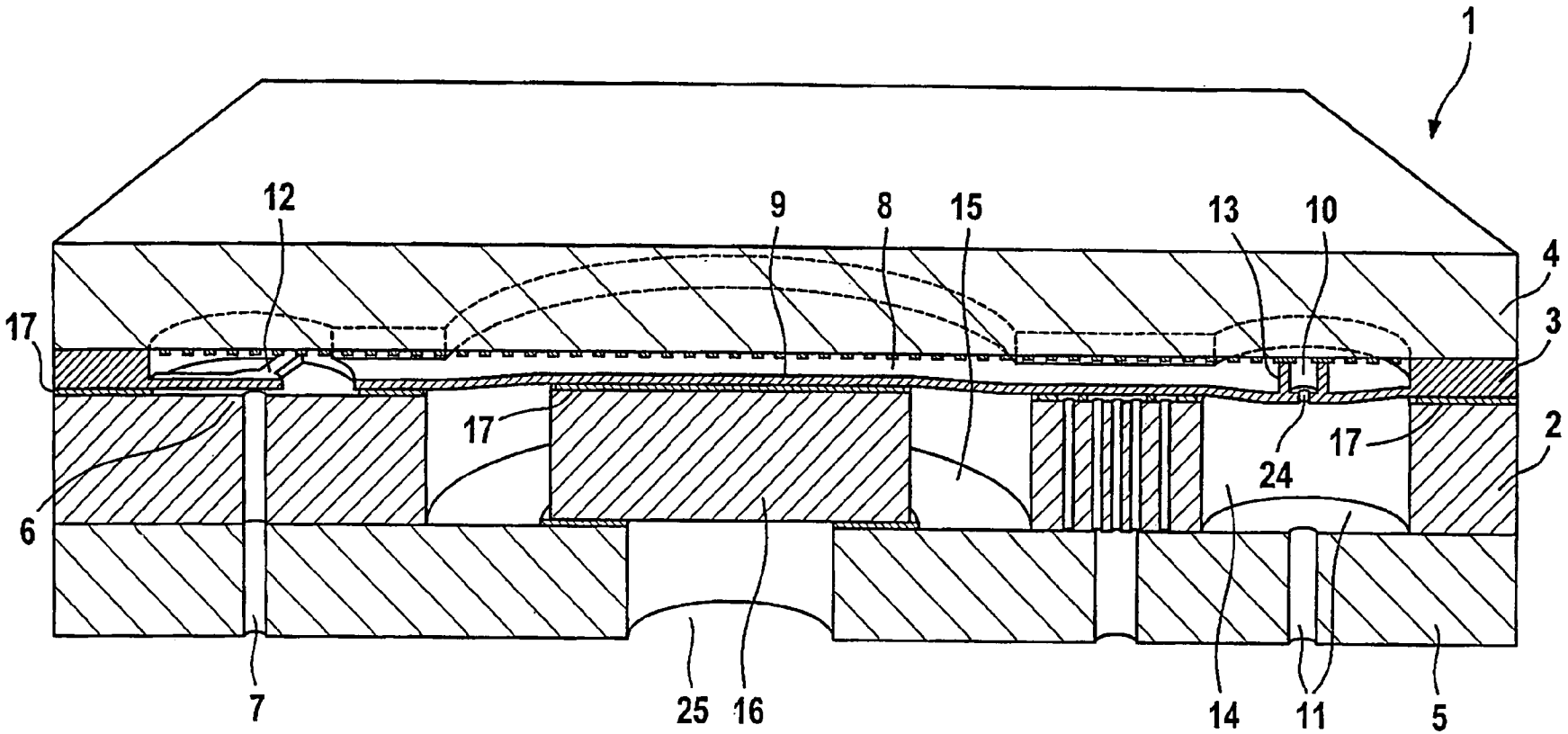
FIG. 1 shows a cross section through a micropump.

FIG. 1 shows a schematic cross section through a micropump 1, which is constructed of a base plate 2, a functional layer 3, a cover plate 4 and a bottom plate 5. A first etch stop layer 17 is situated in edge regions between functional layer 3, which is developed as a polysilicon layer, and base plate 2. Base plate 2 is made, for example, of a patterned silicon layer onto which functional layer 3 is applied on patterned etch stop layer 17. A second functional layer 19 is applied onto functional layer 3 (FIG. 2G), onto which cover plate 4 is applied. Base plate 2 is covered on its underside by bottom plate 5. Micropump 1 has an intake valve 6 via which a fluid is able to flow into a pump chamber 8 from an inlet channel 7 that is inserted into base plate 2 and in bottom plate 5. Pump chamber 8 is developed between a pump diaphragm 9 and cover plate 4. An outlet valve 10 is also provided that is in connection with pump chamber 8. Outlet valve 10 connects pump chamber 8 to an outflow channel 11 which is inserted into base plate 2 and into bottom plate 5. Intake valve 6 has a first closing element 12 that is developed in the form of a flexible crosspiece and is developed as a part of functional layer 3. First closing element 12 is situated above an intake opening of inlet channel 7, via which inlet channel 7 opens out into pump chamber 8. The area of first closing element 12 is dimensioned so that the intake opening of inlet channel 7 is completely covered by first closing element 12. As the sealing seat for first closing element 12 there is used, for example, a circular edge surface of base plate 2 which surrounds the intake opening of inlet channel 7.

Outlet valve 10 has a second closing element 13 which is also developed as a part of functional layer 3, and represents a sleeve shape having an outlet opening 24. The height of the sleeve corresponds to the height of functional layer 3 in the edge region, so that the upper side of the sleeve lies against a ring sealing surface that is situated on the underside of cover plate 4. Outlet opening 24 makes a transition into outlet chamber 14 which is inserted into base plate 2, and represents a part of outflow channel 11. Outlet chamber 14 may have a greater cross section than the part of outflow channel 11 that is inserted into bottom plate 5.

Underneath pump chamber 8 in base plate 2, an actuator room 15 is formed in which a piston 16 is situated. Piston 16 is connected to pump diaphragm 9 via first etch stop layer 17. Underneath piston 16, bottom plate 5 has an opening 25 via which an actuator may be brought to lie against piston 16.

The micropump functions as follows: In the initial state intake valve 6 is open, and outlet valve 10 is closed. Thus, fluid is able to penetrate into the pump chamber. In order to pump a fluid from inlet channel 7 to outflow channel 11, piston 16 is moved up and down. In this context, pump diaphragm 9 is also moved up and down. By the movement of pump diaphragm 9, the volume of pump chamber 8 is periodically reduced in size and enlarged. When there is a reduction in the size of the pump chamber, excess pressure is generated in pump chamber 8, so that outlet valve 10 is opened and lets fluid escape from pump chamber 8 into outlet chamber 14, and intake valve 6 is closed, and prevents an after-flow of fluid. Consequently, a specified quantity of fluid is conveyed per pump stroke. Now, when subsequently piston 16 is pulled back, the volume of pump chamber 8 is increased and a corresponding underpressure is generated in pump chamber 8. Because of the underpressure, intake valve 6 opens and fluid is sucked via inlet channel 7 into pump chamber 8. At the same time, the outlet valve closes again. In response to the underpressure, second closing element 13 of outlet valve 10 lies in a sealing manner against the underside of cover plate 4, so that no fluid is able to flow into the pump chamber via outlet valve 10. Consequently, a back flow of fluid from outlet chamber 14 into pump chamber 8 is avoided.

Figure 2A:
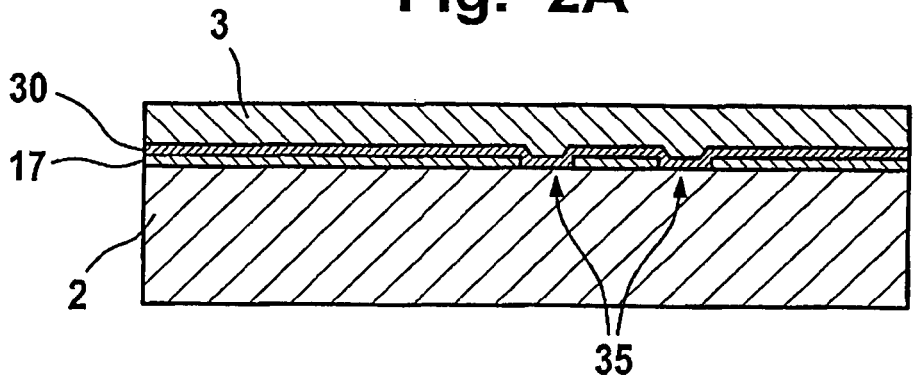
FIGS. 2A-H show method steps for producing the micropump.

A first example production method is explained in connection with FIGS. 2A-H. FIG. 2A shows a base plate 2 in the form of a silicon wafer. On the upper side of base plate 2, first etch stop layer 17 has been applied and patterned. First etch stop layer 17 is also used as a sacrificial layer. First etch stop layer 17 is subdivided into individual independent surface areas. Because of this, upon later removal of a surface area of etch stop layer 17, a lateral etch stop is automatically achieved through functional layer 3, which borders the surface areas of first etch stop layer 17 laterally and upwards. First etch stop layer 17 is made, for instance, of silicon oxide. Functional layer 3 is applied to first etch stop layer 17 and to contact surfaces 35 of base plate 2, and it is preferably made of polysilicon which was preferably produced using an epitactic depositing method as an epitactic polysilicon layer having an EPI starting layer 30. The thickness of functional layer 3 is precisely established by the thickness of the deposited polysilicon layer and by the subsequent polishing method.

Subsequently, a second etch stop layer 18 is applied to functional layer 3, and patterned to have a second pattern. Second etch stop layer 18 is preferably also made of silicon oxide. A second functional layer 19 is applied to second functional etch stop layer 18 and to contact surfaces 36 of functional layer 3. Second layer 19 is preferably made of polysilicon and will have been applied in an epitactic depositing method as an epitactic polysilicon layer having a second EPI starting layer 31. Instead of polysilicon, other micromechanically processable materials may also be used that grow together with first functional layer 3.

Figure 2B:
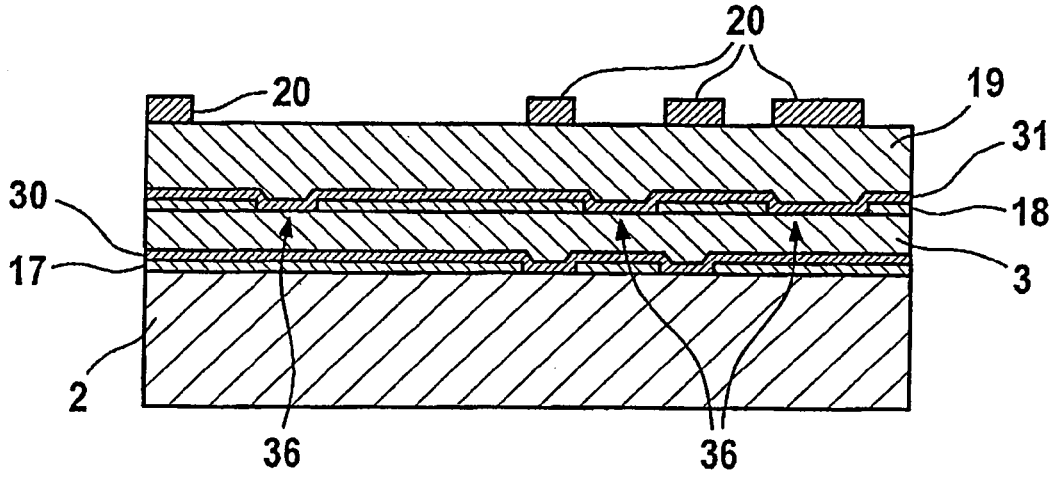

An etching mask 20 is applied to the surface of second functional layer 19, made preferably of photoresist. This situation of the method is illustrated in FIG. 2B.

Figure 2C:
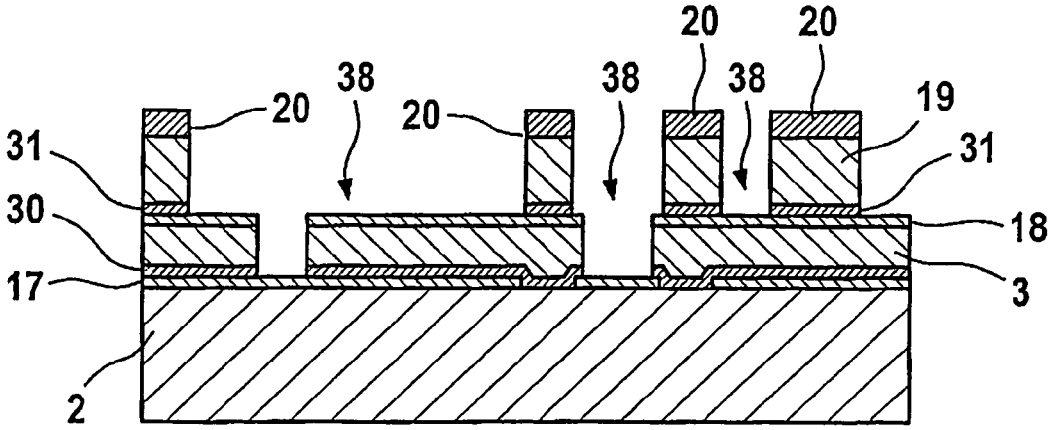

After that, second functional layer 19, in conformance with etching mask 20, is etched away down to second etch stop layer 18, using an anisotropic etching method. In addition, second functional layer 19, in the areas in which no second etch stop layer 18 has been formed, is etched away down to functional layer 3, and functional layer 3 is etched away down to first etch stop layer 17. This situation of the method is illustrated in FIG. 2C. In this way, a component having cavities 38 may be produced for fluidic applications. In order to cover cavity 38, etching mask 20 may be removed, and the functional layer or the base plate may be covered, for example, with a glass plate.

Figure 2D:
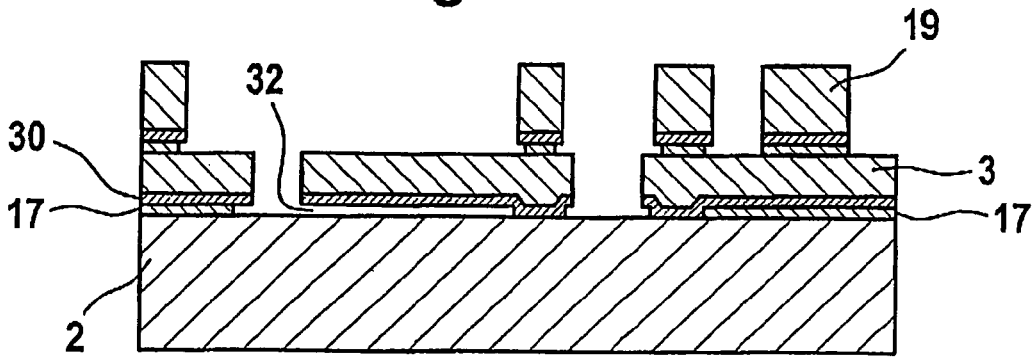
Figure 2E:
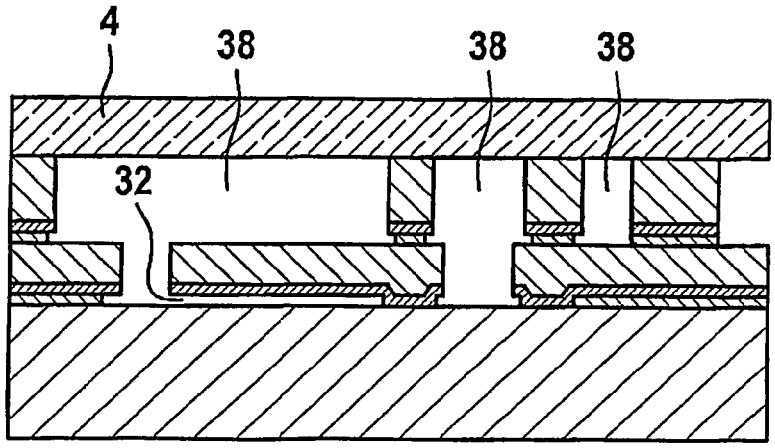
Figure 2F:
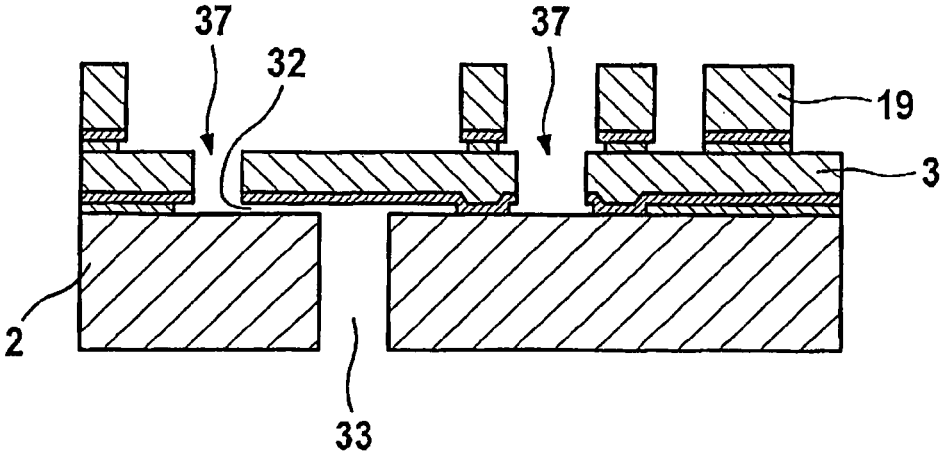

After etching mask 20 is removed, in one further refinement of the method, first etch stop layer 17 is undercut in determined areas, via openings in functional layer 3. Consequently, cavities 32 may be produced in base plate 2 and first functional layer 3. In this way, in addition, first functional layer 3 may be separated in determined areas from base plate 2, and may be formed as movable parts, such as valve diaphragms. This situation of the method is illustrated in FIG. 2D. FIG. 2E shows the component patterned according to the method described, which has been sealed off using a cover plate 4 from the top, according to an anodic bonding method.

Starting from the situation of the method in FIG. 2C, preferably at first base plate 2 may be patterned beginning from the underside, second openings 33 being inserted into base plate 2 which border on first etch stop layer 17. Subsequently, first etch stop layer 17 is etched away in determined areas. Thereupon first functional layer 3 is patterned and base plate 2 is used as etch stop layer in the areas in which first etch stop layer 17 was removed. The result is equivalent to FIG. 2F, etching possibly into base plate 2 being done, beginning from above and via patterned openings 37 in functional layer 3.

Figure 2G:
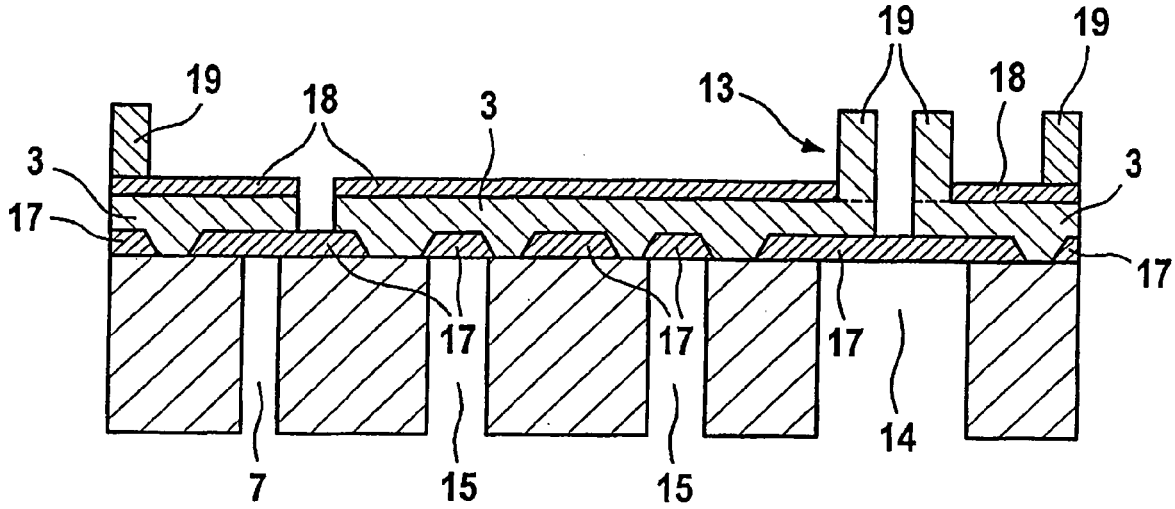

In order to form a micropump, base plate 2, using an appropriate etching mask, is patterned from underneath via an anisotropic etching method in such a way that an inlet channel 7, a ring-shaped actuator chamber 15 and outlet chamber 14 are inserted into base plate 2. Inlet channel 7, actuator chamber 15 and outlet chamber 14 border on separated surface areas of etch stop layer 17. This situation of the method is shown in FIG. 2G.

In the method step described above, starting from below, and going via inlet channel 7, actuator chamber 15 and outlet chamber 14 the surface areas of first etch stop layer 17 that are accessible through these are removed via a selective etching procedure. Because of the lateral limitation of the surface areas, the lateral underetching is also limited, since functional layer 3 is functioning as an etch stop layer.

The patterning of base plate 2, first functional layer 3 and second functional layer 19, that is made up of silicon, may be done using a silicon etching process in which etch stop layers 17, 18, that are made of silicon oxide, are used as etch stops. Subsequently, first and second etch stop layers 17, 18 are removed in the desired areas using selective etching methods. In this context, second etch stop layer 18 is removed on the exposed areas as well as at the edge areas. First etch stop layer 17 is removed in the surface areas bordering on inlet channel 7, actuator chamber 15 and bordering on outlet chamber 14. In this method step, in addition, possible process-conditioned residues of silicon are removed from the pump diaphragm. Between piston 16 and pump diaphragm 9, the first etch stop layer remains intact because of the lateral etch stops. Consequently, it is not necessary to control the etching process as to an etching time. This situation of the method is illustrated in FIG. 2H.

Figure 2H:
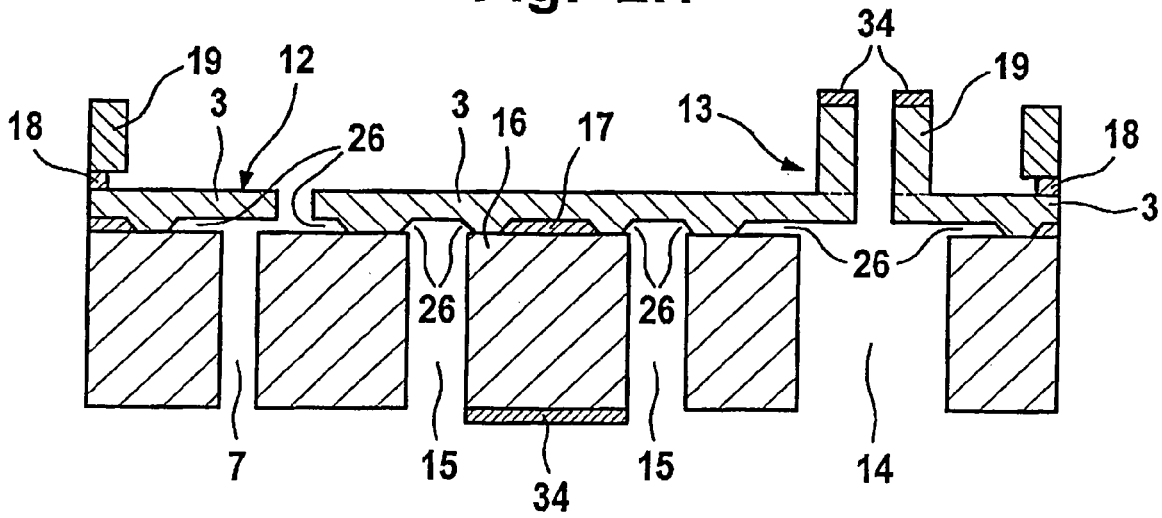

From FIG. 2H it may be seen that functional layer 3, in certain areas, such as, for instance, in the area of first and second closing element 12, 13 and in the area above actuator chamber 15 has a lesser thickness than in other areas. In addition, because of the method described, second closing element 13 is formed in the shape of a sleeve. At the outer edge areas, edge etch stop layer 17 is situated between base plate 2 and functional layer 3, and second edge etch stop layer 18 is situated between functional layer 3 and second layer 19. The surface areas of first edge etch stop layer 17 that have been etched away extend laterally beyond openings 7, 15, 14 of base plate 2 in underetched chambers 26. Underetched chambers 26 are bordered laterally and above by polysilicon layer 3. Thereby the lateral underetching is precisely established by the surfaces of first etch stop layer 17.

Starting from the situation of the method in FIG. 2H, subsequently bottom plate 5 and cover plate 4 are sealingly connected to base plate 2 and second functional layer 19. In this context, as the material for bottom plate 5 and cover plate 4, preferably glass is used, which is connected via an anodic bonding method to base plate 2 and second layer 19. Before the bonding method, in the predefined area an anti-bonding layer 34 is deposited onto cover plate 4 and bottom plate 5, which prevents a connection between second functional layer 19 and cover plate 4 or between base plate 2 and bottom plate 5. The areas are situated over second closing element 13 and under piston 16. Thereby second closing element 13 and piston 16 are not bonded anodically and are consequently movable for opening and closing the outlet valve, or rather, for pumping.

FIGS. 3A-D show the steps of an additional example method for producing a component for fluidic applications, especially for a micropump, in which a sequence of coatings made up of a bottom silicon oxide layer 21, a middle polysilicon layer 22 and an upper silicon oxide layer 23 is built up as etch stop layer 17, which completely covers middle polysilicon layer 22. The layer pattern of FIG. 3A has the same form as first etch stop layer 17 in FIG. 2A. Lower silicon oxide layer 21, middle polysilicon layer 22 and upper silicon oxide layer 23 are applied to base plate 2 using appropriate depositing methods and patterning methods. Subsequently, functional layer 3, which is preferably made up of polysilicon that is applied epitactically, is applied onto the layer pattern and the free areas of base plate 2. Subsequently, second etch stop layer 18 and second layer 19 and etching mask 20 are applied according to the previous method and, in appropriate etching procedures, both base plate 2 is patterned from underneath and so are second layer 19 and functional layer 3. Thereupon, the areas of lower silicon layer 21 laid bare by inlet channel 7, ring-shaped actuator chamber 15 and outlet chamber 14, and the perpendicular walls of base plate 2 and the free areas of the functional layers are covered with silicon oxide, and the laid-bare areas of lower silicon oxide layer 21 are opened using an anisotropic etching method.

Figure 3A:
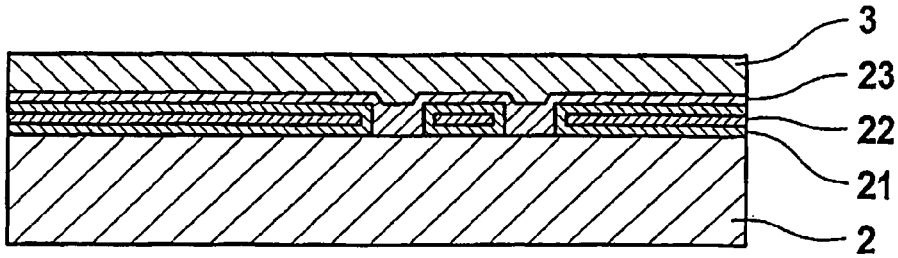
FIGS. 3A-D show process steps of an additional method for producing a micropump.
Figure 3B:
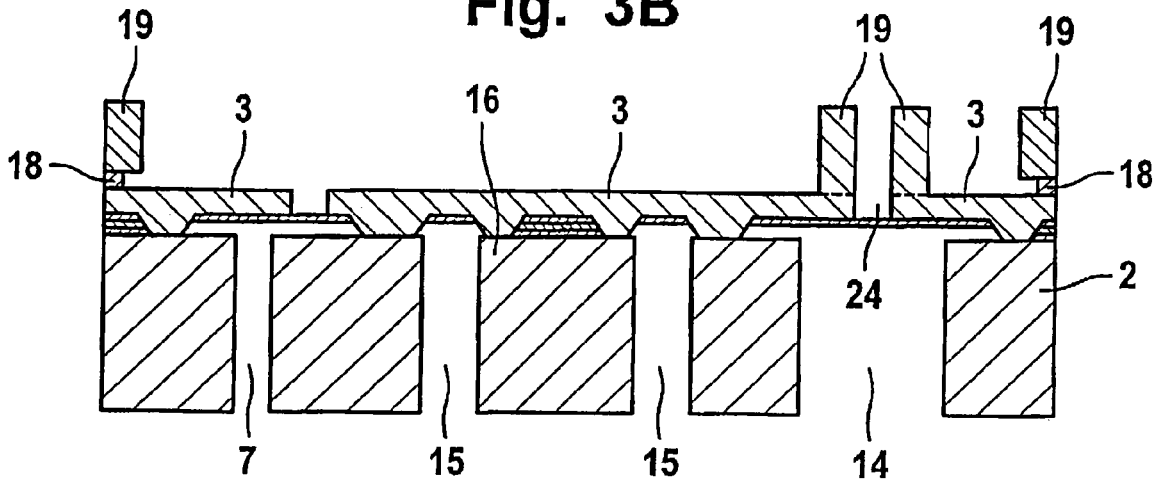

Subsequently, middle polysilicon layer 22 is removed using an isotropic etching method in the laid-bare areas, i.e., above inlet channel 7, above actuator chamber 15 and above outlet chamber 14. This situation of the method is illustrated in FIG. 3B.

In an additional method step, upper silicon oxide layers 23 are removed in the areas of intake valve 6, outlet valve 10 and above actuator chamber 15 via a hydrogen fluoride gas phase etching method. Alternatively, one may also use a wet chemical method in combination with a special drying method (e.g., supercritical drying in $CO_2$).

Figure 3C:
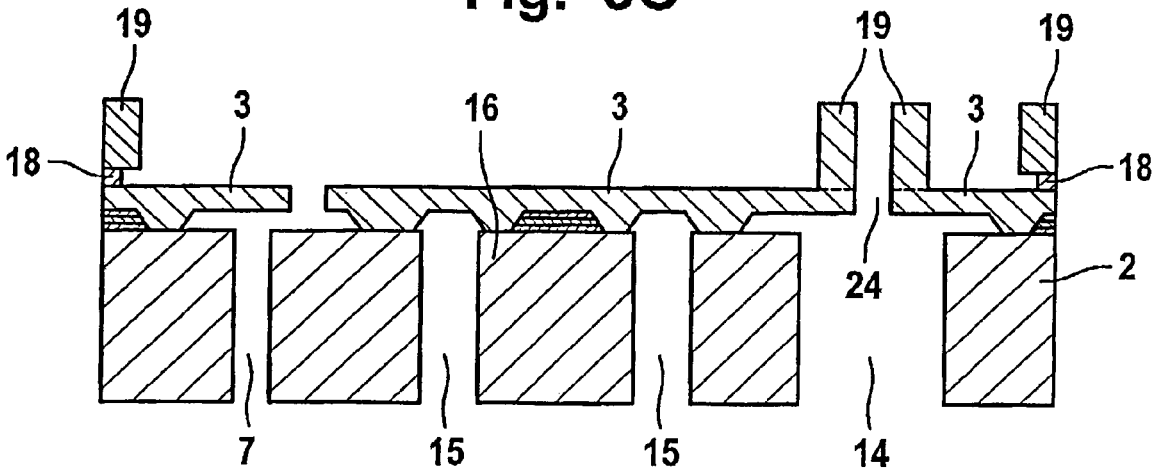

This situation of the method is illustrated in FIG. 3C. Subsequently, bottom plate 5 is applied onto second layer 19, cover plate 4 and the underside of base plate 2. In this context, as was described above, cover plate 4 and bottom plate 5, which are made of glass, are connected in a sealing manner to base plate 2 and outer areas of second layer 19, via an anodic bonding method.

In the anodic bonding method, in order that cover plate 4 and bottom plate 5 shall not adhere to movable parts of first and/or second functional layer 3, 19 or to base plate 2, an anti-bonding layer 34 is applied between cover plate 4 and movable parts of first and second functional layer 3, 19. Anti-bonding layer 34 has the additional advantage, in the area of outlet valve 10, that outlet valve 10 is preloaded against cover plate 4.

Figure 3D:
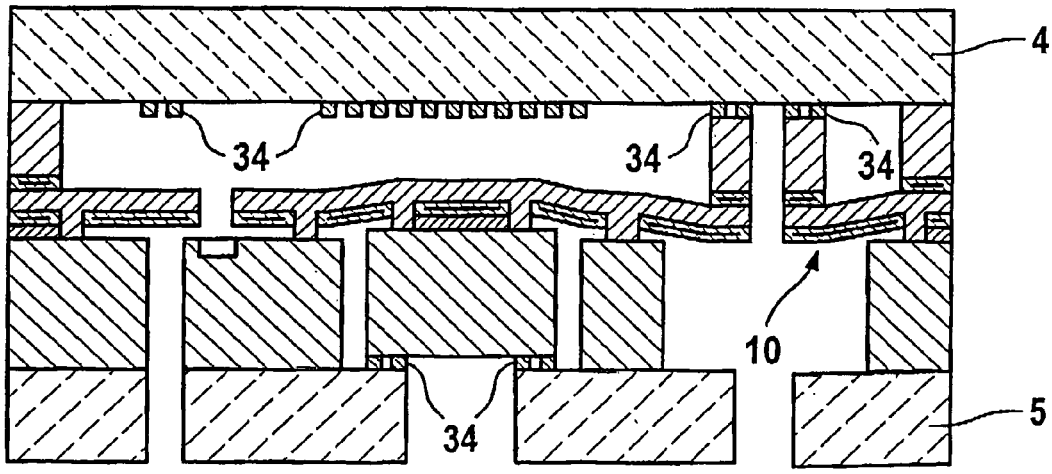

Similarly, an anti-bonding layer 34 is applied between piston 16, base plate 2 and bottom plate 5. Thereby it is ensured that piston 16 remains movable for operating the pump diaphragm. Anti-bonding layer 34 is developed, for example, as a nitride layer. This situation of the method is illustrated in FIG. 3D. Depending on the specific embodiment, anti-bonding layer 34 may also be applied to cover plate 4 or to bottom plate 5.

Middle polysilicon layer 22 is preferably removed by a xenon difluoride ($XeF_2$) or a chlorine trifluoride ($ClF_3$) etching method. The additional schematically shown method in FIGS. 3A-D offers the advantage that, using the etching methods described, large underetching (lateral etching) widths may be rapidly implemented in polysilicon. Furthermore, there is no danger that first closing element 12 of the intake valve adheres to functional layer 3. By removing upper silicon layer 23, using gaseous hydrogen fluoride, adhesion is also avoided, and lateral underetching between base plate 2 and functional layer 3 is also avoided.

What is claimed is:

1. A micropump, comprising:

a first stop etch layer;

a functional layer;

a second stop etch layer;

the first and second stop etch layers positioned at opposite sides of the functional layer;

a pump chamber bordered by a cover plate and a pump diaphragm; and the pump diaphragm held on a base plate, a fluid being able to be sucked in via an intake and being able to be passed out via an outlet by a movement of the pump diaphragm;

wherein the pump diaphragm is formed from a polysilicon layer;

wherein the polysilicon layer has a lesser thickness in predetermined areas, the predetermined areas, including areas of at least one of the intake, the outlet, and the pump diaphragm; and wherein the polysilicon layer is at a distance from the base plate in the predetermined areas.

2. The micropump as recited in claim 1, wherein an intake valve is provided as the intake, the intake valve having an inlet channel that is developed in the base plate, the intake valve being developed as a check valve having a first closing element, the first closing element being developed as a part of the polysilicon layer; and wherein the first closing element is situated above an inlet opening of the inlet channel and covers the inlet opening, and as a sealing seat for the first closing element, an area of the base plate is provided that surrounds the inlet opening.

3. The micropump as recited in claim 2, further comprising:

the cover plate; and an anti-bonding layer inserted between a second closing element of an outlet valve of the outlet and the cover plate, the cover plate being anodically bonded to the second closing element, wherein the second closing element is preloaded as a sealing surface by the anti-bonding layer against the cover plate.

* * * * *